US006986309B2

(12) United States Patent
Sugihara et al.

(10) Patent No.: US 6,986,309 B2
(45) Date of Patent: Jan. 17, 2006

(54) SYNTHETIC RESIN PALLET

(75) Inventors: Junro Sugihara, Tokyo (JP); Soshi Yamamoto, Koshigaya (JP)

(73) Assignee: Dainippon Ink and Chemicals, Inc., Tokyo (JP)

( * ) Notice: Subject to any disclaimer, the term of this patent is extended or adjusted under 35 U.S.C. 154(b) by 422 days.

(21) Appl. No.: 10/451,412

(22) PCT Filed: May 31, 2001

(86) PCT No.: PCT/JP01/04598

§ 371 (c)(1),
(2), (4) Date: Nov. 27, 2002

(87) PCT Pub. No.: WO01/92122

PCT Pub. Date: Dec. 6, 2001

(65) Prior Publication Data

US 2004/0134391 A1 Jul. 15, 2004

(30) Foreign Application Priority Data

May 31, 2000 (JP) ..... 2000-162158

(51) Int. Cl.
*B65D 19/38* (2006.01)

(52) U.S. Cl. ..... 108/57.25

(58) Field of Classification Search ..... 108/57.25, 108/57.26, 57.27, 57.28, 901, 902
See application file for complete search history.

(56) References Cited

U.S. PATENT DOCUMENTS

| | | | | |
|---|---|---|---|---|
| 5,117,762 | A * | 6/1992 | Shuert | 108/57.25 |
| 5,413,052 | A * | 5/1995 | Breezer et al. | 108/57.25 |
| 5,555,820 | A * | 9/1996 | Shuert | 108/57.25 |
| 5,794,544 | A * | 8/1998 | Shuert | 108/57.25 |
| 5,845,588 | A * | 12/1998 | Gronnevik | 108/57.25 |
| 5,868,080 | A * | 2/1999 | Wyler et al. | 108/57.25 |
| 5,967,057 | A | 10/1999 | Nakayama et al. | |
| 6,125,770 | A * | 10/2000 | Brandenburg | 108/57.25 |
| 6,138,582 | A * | 10/2000 | Fujii et al. | 108/57.25 |
| 6,199,488 | B1 * | 3/2001 | Favaron et al. | 108/57.25 |
| 6,237,509 | B1 * | 5/2001 | Ishido et al. | 108/57.25 |
| 6,283,044 | B1 * | 9/2001 | Apps | 108/57.25 |
| 6,622,642 | B2 * | 9/2003 | Ohanesian | 108/57.25 |

FOREIGN PATENT DOCUMENTS

| | | |
|---|---|---|
| AU | 731252 | 5/1998 |
| CN | 1186039 A | 7/1998 |
| EP | 0 839 732 A2 | 5/1998 |
| JP | 50-136153 | 11/1975 |
| JP | 10-129668 | 5/1998 |

* cited by examiner

*Primary Examiner*—Jose V. Chen
(74) *Attorney, Agent, or Firm*—Armstrong, Kratz, Quintos, Hanson & Brooks, LLP

(57) ABSTRACT

A plastic pallet including a square upper plate part and lower plate part, and columns connecting the upper plate part and the lower plate part. Fork insertion apertures are formed between the columns in the side faces of the pallet. Rectangular reinforcing frames are multiply formed surrounding the cross-section of the fork insertion apertures orthogonal to the fork insertion direction, and a hollow portion is formed inside these reinforcing frames, along at least three sides of the reinforcing frame.

4 Claims, 15 Drawing Sheets

SYNTHETIC RESIN PALLET

BACKGROUND OF THE INVENTION

1. Field of the Invention

The present invention relates to plastic pallets used in situations such as transportation and storage of various articles and the like.

2. Description of the Related Art

Conventionally, when transporting and storing articles, wooden pallets have been used, but recently, plastic pallets are becoming more popular because they have the advantages that they are lighter than wood, do not degrade easily, and do not generate splinters which are characteristic of woods. In particular, the integrally molded pallet where both the upper and lower surfaces are injection molded as one, is used in place of wooden pallets in a wide range of fields because of its high production efficiency.

This type of plastic pallet, as shown for example in FIG. 23, has a rectangular upper plate part 200 and a lower plate part 202, and a plurality of columns 204 connecting the upper plate part 200 and the lower plate part 202, and a pair of fork insertion apertures 206 are formed parallel to each other between these columns 204. In the example of FIG. 23, the fork insertion apertures 206 are formed only on two sides, but there are also models where pairs of fork insertion apertures are formed on all four sides.

The upper plate part 200 is called a deck board, and as shown in FIG. 24, has many beams 208 extending horizontally. Similarly, the lower plate part 202 has many beams 212 extending horizontally. Because the beams 208 that form the upper plate part 200 and the beams 212 that form the lower plate part 202 are arranged shifted alternately, many holes are respectively formed between the beams 208 and between the beams 212. For the beams 208 and 212, the cross-section is generally constructed in the form of a 'U' or a 'T', and these are devised in order to increase the strength of the upper plate part 200 and the lower plate part 202.

The columns 204 are formed with many vertical walls 210 combined length and breadthwise, and connect the beams 208 and 212. To prevent bending of the vertical walls 210, reinforcing ribs 214 are formed at some places along the vertical walls 210 and connected to the beam 208 and 212.

FIG. 25, illustrates a method disclosed in Japanese Examined Patent Application, Second Publication number Sho 49-582, as one example of a molding method for this kind of integrally molded pallet. As shown in this figure, because the beam 208 and 212 pairs are displaced horizontally, even if complicated slide cores are not multiply used, this can be formed relatively easily between an upper mold 216 and a lower mold 218. In addition, compared to the case where the upper and lower parts are formed separately and the pallet then formed by joining the two together, the time-consuming joining process is unnecessary. Therefore, the production efficiency of the integrally molded pallet is high.

However, in the case where the pallet is loaded with opposite ends of the pallet supported, in the above-mentioned plastic pallet, there is a problem in that because the four corners of the fork insertion aperture 206 are subjected to a large bending stress, the fork insertion aperture 206 are easily deformed into a parallelogram, and the entire pallet bends easily compared to the wooden pallet.

SUMMARY OF THE INVENTION

An object of the present invention is to provide a plastic pallet where the strength of the whole pallet can be increased by increasing the rigidity of the surroundings of the fork insertion apertures in particular, and moreover for which production efficiency is high.

To achieve the above object, the plastic pallet of the present invention comprises an upper plate part and a lower plate part arranged parallel to each other, and a plurality of columns connecting the upper plate part and lower plate part, and fork insertion apertures being formed between the columns. Corresponding to the fork insertion apertures, there is formed a reinforcing frame surrounding a cross-section perpendicular to a fork insertion direction of the fork insertion apertures, and a hollow portion is formed in an interior of at least one portion of the reinforcing frame.

According to the present invention, because each of the reinforcing frame of which at least one part has a hollow construction surrounds the fork insertion aperture, it is possible to suppress any distortion of the cross-section shape of the fork insertion apertures when a heavy load is applied, and as a result, it is possible to increase the rigidity of the plastic pallet.

The reinforcing frame may have an upper horizontal beam formed along the upper plate part, a lower horizontal beam formed along the lower plate parts and a pair of vertical beams connecting the upper horizontal beam and the lower horizontal beam, and at least three of the upper horizontal beam, the lower horizontal beam and the pair of vertical beams may have hollow portions communicating with each other.

Of the upper horizontal beam, the lower horizontal beam and the pair of vertical beams, a section which does not have a hollow portion in the interior may have a thickness smaller than that of a section which does have a hollow portion in the interior. More specifically, it is desirable that the width of the section that does not have a hollow portion in the interior is 10 to 50% of the width of the section that does have a hollow portion in the interior.

The upper horizontal beam, the lower horizontal beam and the pair of vertical beams may all have hollow portions communicating with each other.

A gas inlet communicating with the hollow portion may be formed in an outer face of the reinforcing frame, and a non-slip member to close the gas inlet may be attached to the upper plate part or the lower plate part. In this case, it is possible to prevent the infiltration and the like of rain water from the gas inlet.

DETAILED DESCRIPTION OF THE PREFERRED EMBODIMENTS

Hereunder is a description of suitable embodiments of plastic pallets according to the present invention, with reference to the drawings. However, the present invention is not limited to the following embodiments, and may involve for example appropriate combinations of constituent elements of these embodiments.

First Embodiment

Figure 1:
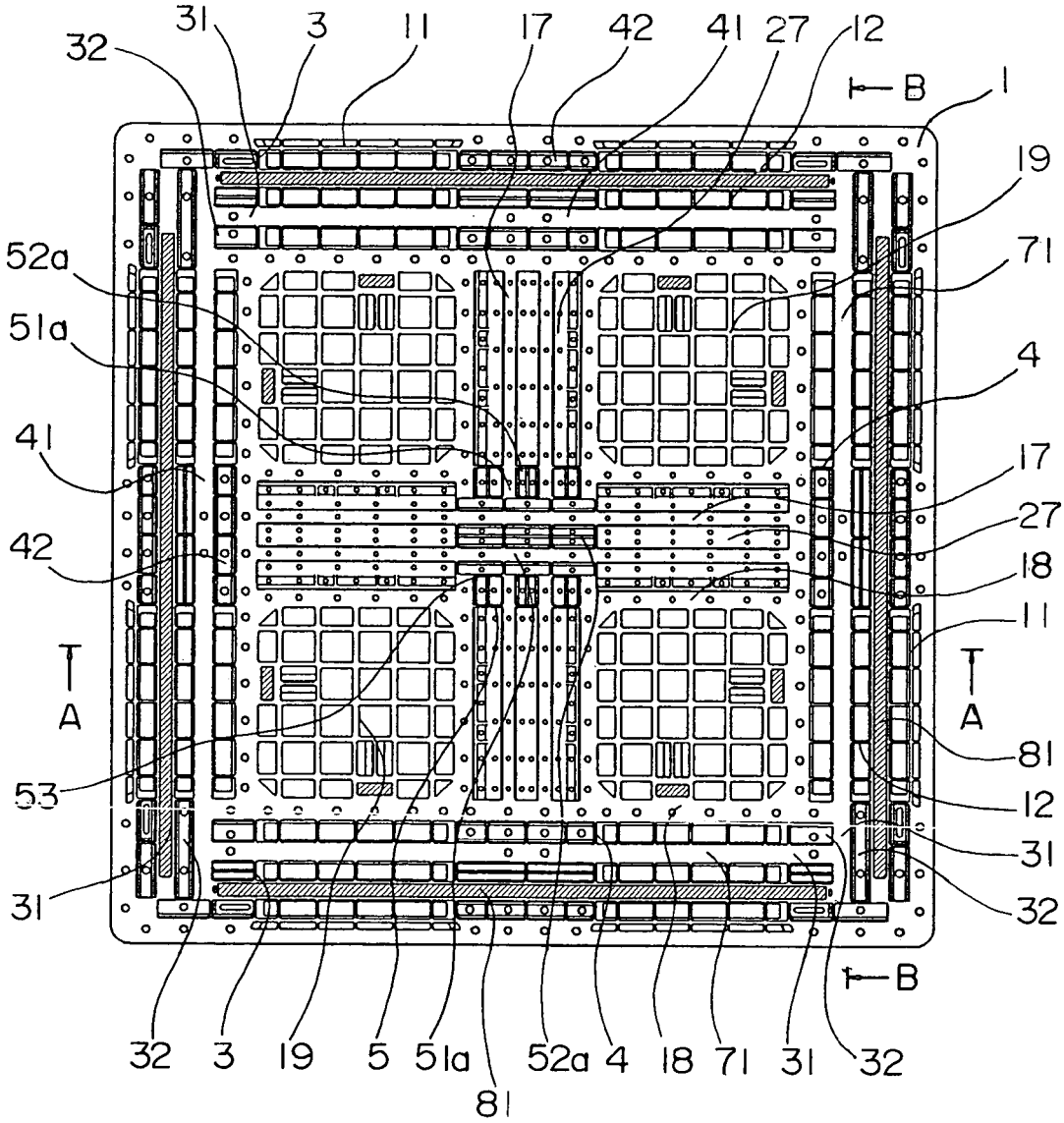
FIG. 1 is a plan view showing a plastic pallet of a first embodiment of the present invention.
Figure 2:
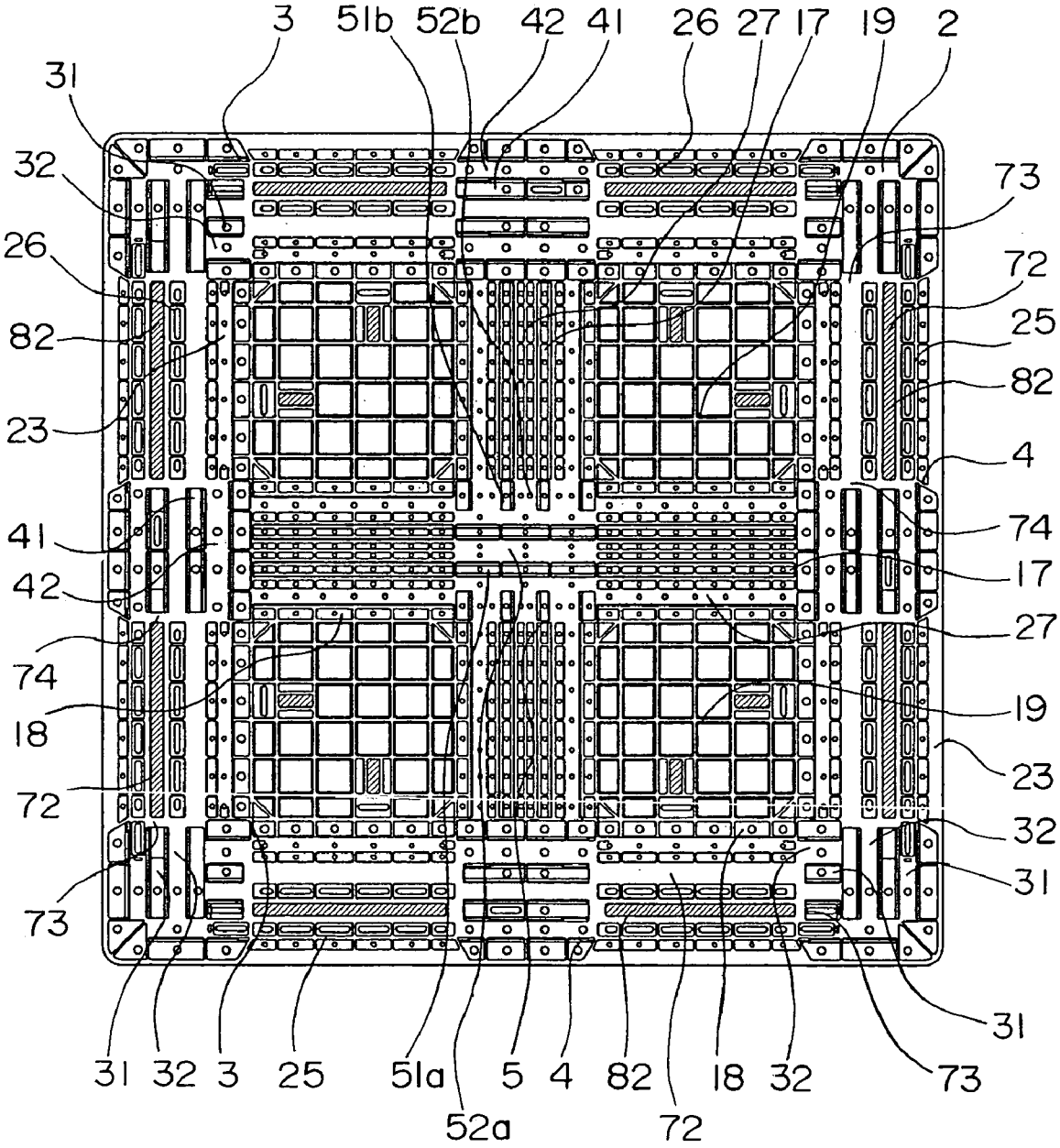
FIG. 2 is a bottom view of the plastic pallet of the first embodiment.
Figure 3:
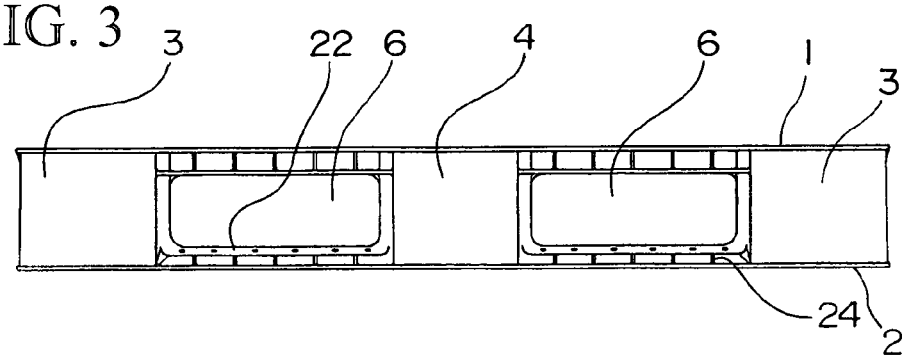
FIG. 3 is a front elevation of the plastic pallet of the first embodiment.
Figure 4:
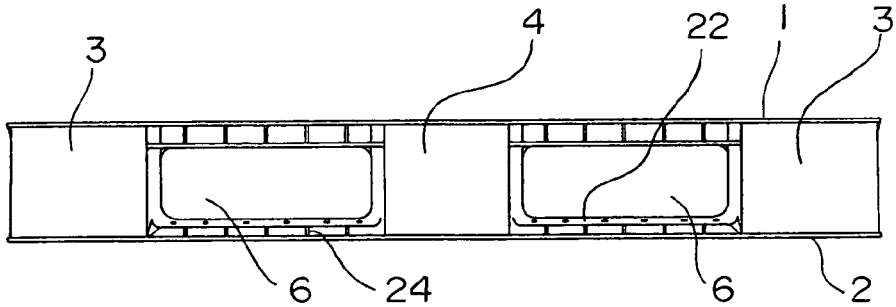
FIG. 4 is a side elevation of the plastic pallet of the first embodiment.
Figure 5:
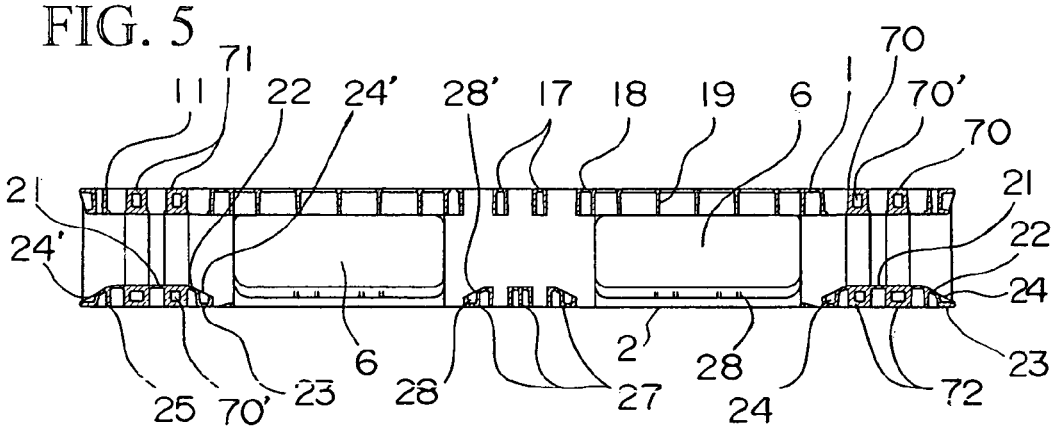
FIG. 5 is a cross-section along the line A—A in FIG. 1.
Figure 6:
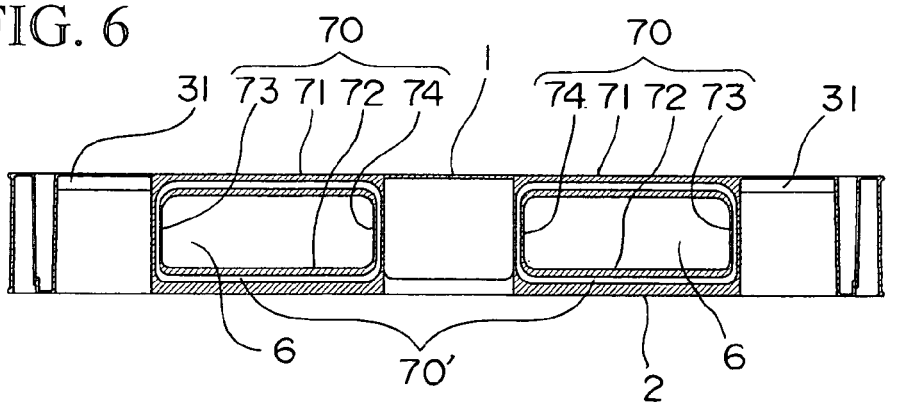
FIG. 6 is a cross-section along the line B—B in FIG. 1.

FIG. 1 through FIG. 6 show a first embodiment of a plastic pallet of the present invention. FIG. 1 is a plan view, FIG. 2 is a bottom view, FIG. 3 is a front elevation, FIG. 4 is a side elevation, FIG. 5 is a cross-section along the line A—A in FIG. 1, and FIG. 6 is a cross-section along the line B—B.

The plastic pallet of this embodiment is of box shape overall, and has a square upper plate part 1 and a square lower plate part 2 arranged parallel to each other, and columns 3, 4 and 5 connecting the upper plate part 1 and the lower plate part 2. The columns 3 are formed at the four corners of the upper plate part 1 and the lower plate part 2, the columns 4 are formed at the midsections of the four sides of the pallet, and the column 5 is formed at the center section of the pallet. All of the columns are constructed by many vertical walls.

Respective pairs of rectangular shaped fork insertion apertures 6 are formed between the columns 3 and 4 in the side faces of the four sides of the pallet, and these fork insertion apertures 6 pass horizontally through the whole pallet between the columns 4 and 5. Accordingly, in the pallet of this embodiment, it is possible to insert two forks from the direction of any of the four sides. However, the plastic pallet of the present invention is not limited to this construction. The fork insertion aperture may also be formed only on the two opposite sides (refer FIG. 18), and the columns and the position and number of the fork insertion apertures may also be changed appropriately.

A feature of the present invention, as shown in FIG. 6, is that the rectangular reinforcing frames 70 are multiply formed surrounding the cross-section of the fork insertion apertures 6 orthogonal to the fork insertion direction, for each of the four fork insertion apertures 6, and a hollow portion 70' is formed inside each of these reinforcing frames 70, around the whole circumference of the reinforcing frame 70.

In this embodiment, in the vicinity of the openings of both ends of each fork insertion aperture 6, namely between the columns 3 at the four corners and the columns 4 at the side midsections, is respectively formed two reinforcing frames 70. In the case where the reinforcing frames 70 are formed in the vicinity of both ends of the fork insertion apertures 6 in this way, when the forks are inserted into the fork insertion apertures 6, it is possible to support the load particularly from the front ends and the rots (rear ends) of the fork with the reinforcing frame 70. Therefore, this is more desirable than the construction where the reinforcing frame 70 is formed only in the midsection of the fork insertion aperture 6. However, the present invention is not limited to this construction. The formation position of the reinforcing frame 70 may be changed optionally, if necessary. The number of reinforcing frames 70 for one fork insertion aperture 6 is not particularly limited, and it is acceptable to provide for example 1 to 6 according to the total length of the fork insertion aperture 6.

The reinforcing frame 70 of this embodiment is consisted of an upper horizontal beam 71 formed in the upper plate part 1, a lower horizontal beam 72 formed in the lower plate part 2, a vertical beam 73 extending vertically along the columns 3 at the four corners, and a vertical beam 74 extending vertically along the columns 4 at the midsections of the sides. The hollow portions 70' respectively formed inside the upper horizontal beam 71, the lower horizontal beam 72 and the vertical beams 73 and 74, are communicated with each other.

The hollow portions 70' are formed as a cavity equivalent to the volume decrease caused by the process of solidifying the resin at the inner section of the beams 71 to 74, by for example the infusion of high pressure gas from the middle section of the upper horizontal beam 71, immediately after the injection molding of the plastic pallet. Accordingly, it is possible to also prevent a roughening of the surface caused by shrinkage, and a drop in molding accuracy. Moreover, an effect is also obtained of shortening the solidifying time of the beams 71 to 74, by making the cross-section midsection that is hard to solidify hollow.

By forming the beams 71 to 74 as a rectangular cylinder having the hollow portion 70' inside, the production efficiency is not decreased, and the weight of the pallet is also not increased by a significant amount, in comparison to the conventional beams of a U shape or a T shape in cross-section. However, it is possible to considerably increase the strength of the periphery of the fork insertion apertures 6. Consequently, in the case where the pallet bears a heavy load, it is difficult for the fork insertion apertures 6 to change into a parallelogram, and it is possible to suppress the bending of the pallet.

As for the upper horizontal beam 71 and the lower horizontal beam 72 of this embodiment, the cross-section is rectangular, and while the dimensions are not limited, in general it is desirable that the width in the horizontal direction is 15 to 50 mm and the thickness in the vertical direction is 15 to 40 mm.

The vertical beam 73 and the vertical beam 74 also have rectangular cross-sections, and it is desirable that the width in the fork insertion direction is equal to the width of the upper horizontal beam 71 and the lower horizontal beam 72, and that the thickness in the perpendicular direction to the fork insertion direction is 10 to 30 mm.

As shown in FIG. 1, on the upper plate part 1, between the columns 3 at the four corners and the columns 4 at the midsections of the sides, a beam 11 is formed so as to extend parallel to the upper horizontal beam 71, and a beam 12 is formed so as to extend in the fork insertion direction, and the upper horizontal beam 71 and the beam 11 and the beam 12 intersect as a grid. Many openings are formed between each grid.

As shown in FIG. 5, on the lower plate part 2, between the columns 3 at the four corners and the columns 4 at the midsections of the sides, a horizontal plate 21 is formed so that the insertion of the fork or the pallet truck is performed smoothly along the upper edge of the lower horizontal beam 72. Moreover, on each side of the horizontal plate 21, there is formed, a downward sloping inclined face 22, and a downward sloping inclined edge 24' formed with ribs 24 provided on a bottom plate 23. By forming this kind of horizontal plate 21, inclined face 22 and inclined edge 24' on the lower plate part 2, it is possible to improve the operability at the time of inserting the fork of a pallet truck, in and out of the fork insertion aperture 6.

On the rear face of the horizontal plate 21, as shown in FIG. 5, beams 25 are formed so as to extend parallel to the lower horizontal beams 72, and beams 26 are formed so as to extend in the fork insertion direction, and the lower horizontal beam 72 and the beams 25 and 26 intersect as a grid.

Inside the columns 3 formed at the four corners, as shown in FIG. 6, beams 31 that connect to the upper horizontal beam 71 are formed on the upper plate part 1, and on the lower plate part 2, beams 32 that extend in the same direction as the beam 31 are formed so as not to vertically overlap with the beams 31.

Inside the columns 4 at the side midsections, on the upper plate part 1 as shown in FIG. 1, beams 41 that connect to the upper horizontal beams 71 are formed. As shown in FIG. 2, on the lower plate part 2, beams 42 are formed in the same direction as the beams 41, so as not to vertically overlap with the beams 41.

Inside the column 5 formed at the center of the pallet, beams 51*a* are formed between the column walls facing the upper plate part 1, and on the lower plate part 2, beams 52*a* are formed so as to extend in the same direction as the beams 51*a*, so as not to vertically overlap with the beams 51*a*. In addition, beams 51*b* are formed between the column walls and partition walls 53, and also, on the lower plate part 2, beams 52*b* are formed so as to extend in the same direction as the beams 51*b* so as not to vertically overlap with the beams 51*b*.

Between the columns 4 formed at the side midsection and the column 5 formed at the center of the pallet, on the upper plate part 1, beams 17 are formed for connecting the columns 4 formed at the side midsection and the column 5 formed at the center of the pallet. There are also beams 27 formed on the lower plate part 2, for connecting the columns 4 formed at the side midsection and the column 5 formed at the center of the pallet, at a position so as not to vertically overlap with the beams 17.

Moreover, ribs 28 are formed at the left and right edges of the beam 27 which connect the columns 4 at the side midsections and the column 5 at the center of the pallet, and by forming inclined sides 28' by these ribs 28, it is possible to improve operability at the time of inserting the forks of a hand-lifter, in and out of the fork insertion apertures 6.

The beams 17 connecting the columns 4 at the side midsection and the column 5 at the center of the pallet on the upper plate part, are connected to the beams 51*a* or 51*b* that are formed inside the column 5 at the center of the pallet. In addition, the beams 27 that connect the columns 4 at the side midsection and the column 5 at the center of the pallet on the lower plate part 2, are connected to the beams 52*a* or 52*b* that are formed in the inside of the column 5 at the center of the pallet.

In the section where the fork insertion apertures 6 intersect, on the upper plate part 1, a rectangular peripheral portion 18 that surrounds the periphery of the intersecting section is formed and on the inner side of this rectangular peripheral portion 18, a grid beam 19 comprising many intersecting beams is formed. On the lower plate part 2 at a position opposite to the grid beam 19, rectangular openings of approximately the same dimensions as the grid beam 19 are respectively formed.

On the upper plate part 1 of the plastic pallet, a plastic non-slip tape 81 is attached to the top of each upper horizontal beam 71. By providing this type of non-slip tape 81, when articles are placed and transported on the plastic pallet, it becomes difficult for the articles to slip on the plastic pallet. Non-slip tape 81 may also be respectively provided on the upper horizontal beams 71, the beams 31 and the beams 41.

Figure 8:
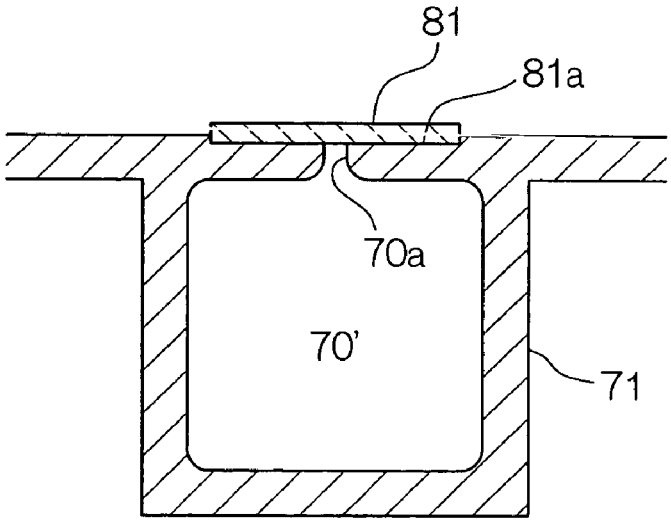
FIG. 8 is a cross-section showing a securing construction for a non-slip seal in the plastic pallet of the first embodiment.
Figure 9:
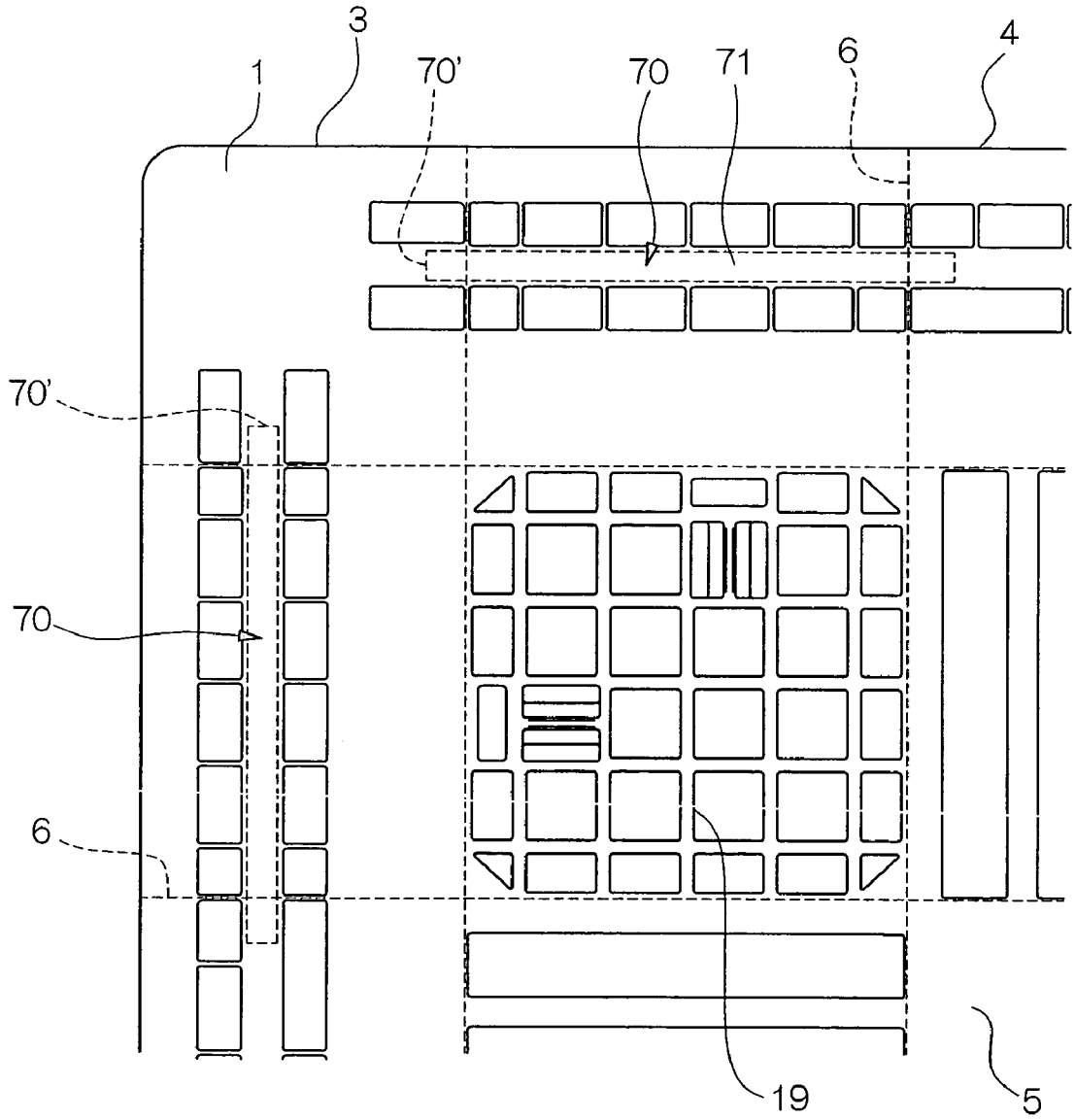
FIG. 9 is a plan view showing a second embodiment of a plastic pallet of the present invention.

FIG. 8 shows one example of an attachment configuration for the non-slip tapes 81. On the upper horizontal beam 71, a shallow hollow 81*a* with a width slightly larger than the width of the non-slip tape 81 is formed, and the non-slip tape 81 is bonded to the middle of this hollow 81*a*. For the method of bonding, a method where the bonding surface is heated and melted and the surfaces then clamped together is suitable.

The depth of the hollow 81*a* is made smaller (for example 1 mm) than the thickness of the non-slip tape 81 (for example 2 mm), so that an effect of slippage prevention by the non-slip tape 81 is obtained, while preventing displacement of the non-slip tape 81. In addition, the non-slip tape 81 also achieves the effect of blocking the gas inlet 70*a* of the hollow portion 70'. There is the possibility that rain water may infiltrate into to the hollow portion 70' if the gas inlet 70*a* is left open.

Non-slip tapes 82 are attached to the bottom surface of the lower horizontal beam 72 on the bottom surface of the lower plate part 2 of the plastic pallet, in the same way as for the non-slip tapes 81. Accordingly, in the case where articles are loaded on the plastic pallet and the pallets stacked, the event of the upper plastic pallet placed on the articles on the lower pallet, slipping on the good on the lower pallet can be suppressed.

For the material of the non-slip tape 81 and 82, for example ethylene-vinyl acetate copolymer, polyolefin type elastomer and the like can be given.

The plastic pallet of the present invention can be formed by plastics such as polyethylene, polypropylene and the like, and additives such as coloring and fillers may be appropriately added into the plastic. The reinforcing frame that is the feature of the present invention, is also constructed of the same material as that of the plastic pallet body. Of course, for the materials of the pallet, plastics of higher strength than polyethylene or polypropylene may be used.

The plastic pallet of the present invention can be formed by injection molding involving injecting a melted plastic into a metal mold. When injecting the melted plastic into the metal mold, by filling gas into the middle of the melted plastic that has been injected into the metal mold, it is possible to form the hollow portion 70' in the interior of the upper and lower horizontal beams 71 and 72, and the vertical beams 73 and 74. Accordingly, while the thickness is large, distortion due to shrinkage is small, and the smooth orthogonal horizontal beams 71 and 72 and vertical beams 73 and 74 having smooth surfaces can be formed.

Figure 7:
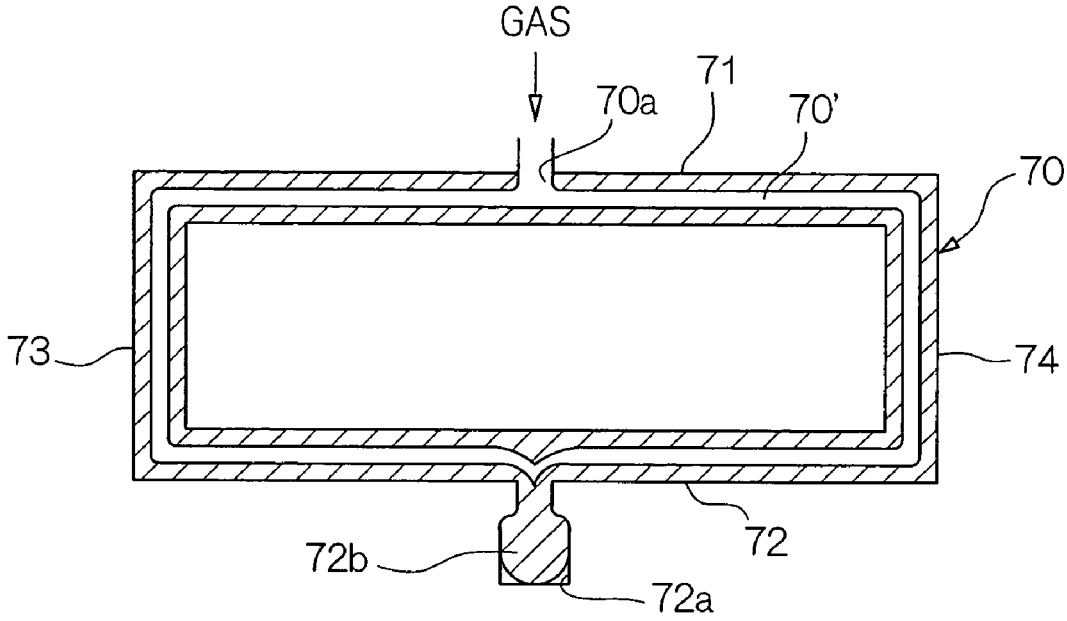
FIG. 7 is a cross-section illustrating an example of a manufacturing method of a plastic pallet of the first embodiment.

In order to form the hollow portion 70' that extends around the entire periphery of the reinforcing frame 70, a resin receiver 72*a* as shown in FIG. 7, is formed on the inner section of the injection molding mold on the opposite side to the gas inlet 70*a*, so that the resin may flow out into this resin receiver 72*a* as a waste tab 72*b*. According to this procedure, it is easy to form the hollow section 70' along the entire periphery of the reinforcing frame 70.

The plastic pallet of this embodiment, is a single side use type which can only carry articles on the upper plate part 1, having large openings provided in the lower plate part 2 below the intersecting sections of the fork insertion apertures 6, so that it can be transported by a hand-lifter. However, the present invention can also be applied to a both side use type plastic pallet where articles can be placed on either of the upper plate part 1 or the lower plate part 2. In addition, in this embodiment the pallet is a four-way type where the forks can be inserted from any of the sides, however the present invention can also be applied to two-way types where the forks are inserted from two sides.

The reinforcing frame 70 may have a shape corresponding to the fork insertion apertures 6, but is not particularly limited to this shape. However, it is desirable that the cross-section of the reinforcing frame 70 is rectangular from the point of ease of manufacture and the degree of reinforcing effect.

As described above, regarding the plastic pallet this embodiment, by forming a hollow reinforcing frame 70 surrounding the fork insertion apertures 6, the weight of the plastic pallet is not increased, but it is possible to increase the strength near the fork insertion apertures 6.

In addition, in the plastic pallet of the present embodiment, the non-slip tapes 81 and 82 are provided on the upper and lower horizontal beams 71 and 72 of the reinforcing frame 70 tit are not easily deformed under load and are very strong. Therefore, in the case where articles are placed on and transported on the plastic pallet, and articles and the plastic pallets are stacked in multistages, a superior non-slip effect is obtained.

Furthermore, in the plastic pallet of the present embodiment, by forming the hollow section 70' in the interior of the upper and lower horizontal beams 71 and 72, then regardless of the large width (thickness), it is possible to reduce distortion due to resin shrinkage, and make the surface of the upper and lower horizontal beams 71 and 72 smooth. Accordingly, the surface of the non-slip tapes 81 and 82 that are provided on the upper and lower horizontal beams 71 and 72, becomes smooth, and the non-slip effect can be made even better.

Second Embodiment

Next, FIG. 9 to FIG. 12 show a second embodiment of the present invention. The same reference symbols are used for places corresponding to respective parts of the first embodiment, and description is omitted.

Figure 11:
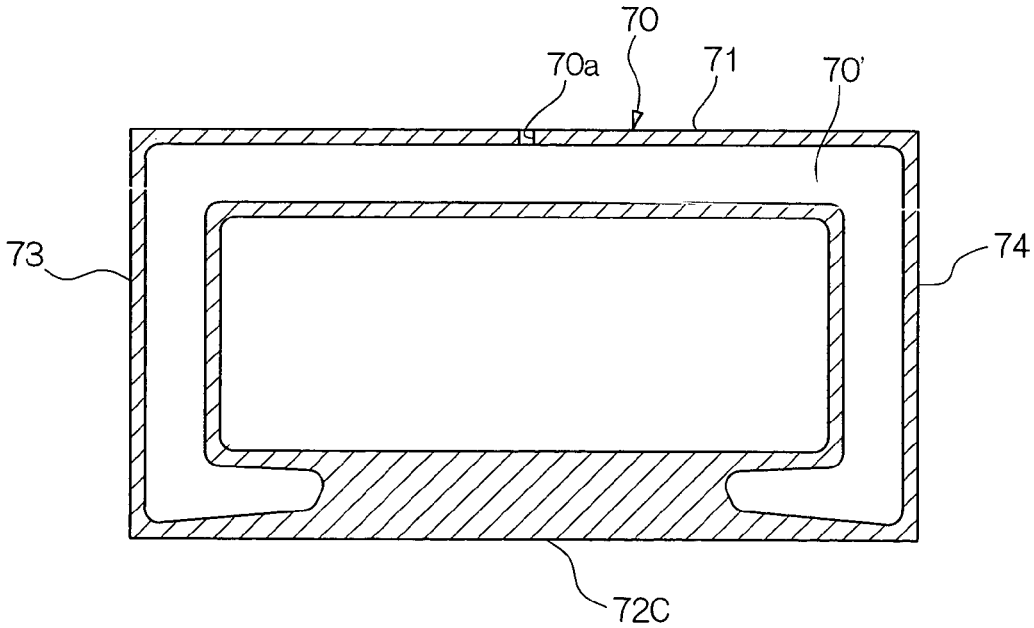
FIG. 11 is a cross-section of a reinforcing frame in the plastic pallet of the second embodiment.

The main difference is that, in the first embodiment, as shown in FIG. 6, the hollow section 70' is formed along the whole periphery of the reinforcing frame 70, while in this embodiment, as shown in FIG. 11, the hollow section 70' is formed only in one part of the reinforcing frame 70.

Figure 10:
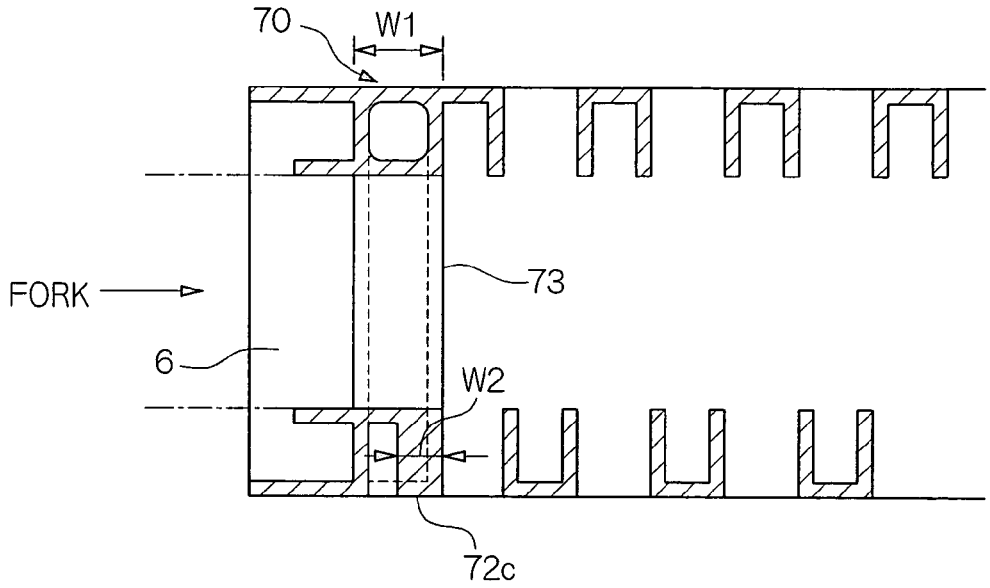
FIG. 10 is a cross-section of the plastic pallet of the second embodiment cut parallel to at a fork insertion aperture.

The reinforcing frame 70 of the second embodiment, as shown in both FIG. 10 and FIG. 11, has an upper horizontal beam 71 that surrounds the four sides of the fork insertion apertures 6, vertical beams 73 and 74 and a lower horizontal beam 72*c*. In this embodiment, only the opposite side portions of the lower horizontal beam 72*c* are made hollow, and are connected to each hollow part of the vertical beams 73 and 74. Accordingly, the four corners of the reinforcing frame 70 are all manufactured hollow with a high degree of strength.

Figure 12:
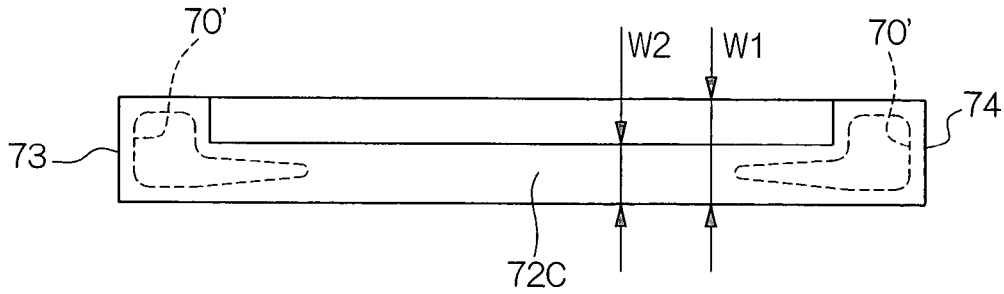
FIG. 12 is a bottom view of the reinforcing frame in the plastic pallet of the second embodiment.

On the other hand, the section not including the opposite side portions of the lower horizontal beam 72*c* is of a solid construction. Moreover, in comparison to the upper horizontal beam 71 and the vertical beams 73 and 74, as shown in FIG. 10 and FIG. 12, the width in the fork insertion direction is made smaller. In this embodiment, as shown in FIG. 12, the lower horizontal beam 72*c* is formed along one side in the width direction of the reinforcing frame 70. However, it is not limited to this construction, and as shown in FIG. 13, the lower horizontal beam 72*c* may be formed along the center line of the reinforcing frame 70.

Figure 13:
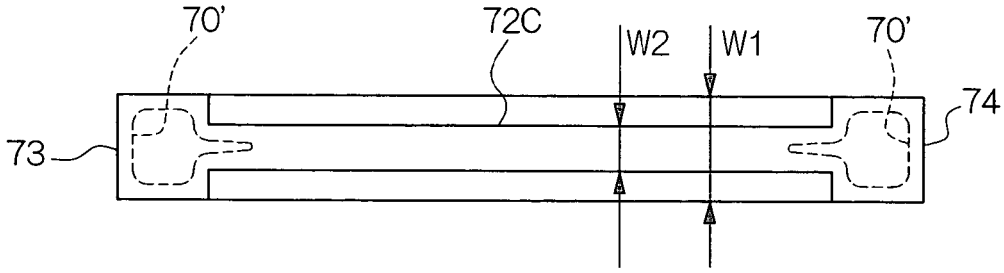
FIG. 13 is a bottom view of a reinforcing frame of a modified example.
Figure 14:
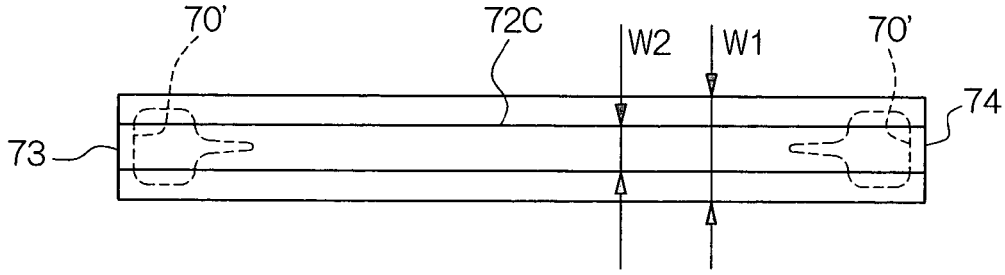
FIG. 14 is a bottom view of the reinforcing frame of the modified example.

In addition, in the example shown in FIG. 12 and FIG. 13, the opposite ends of the lower horizontal beam 72*c* that intersect with the vertical beams 73 and 74 are made thick. However, as shown in FIG. 14, the opposite ends of the lower horizontal beam 72*c* may be made thin.

Preferably a ratio W2/W1 of a width W2 of the middle section of the lower horizontal beam 72*c* to a width W1 of the upper horizontal beam 71, is from 0.3 to 0.8, and more preferably from 0.4 to 0.6. If within this range, the balance of strength and ease of molding is good According to this second embodiment, because there no need to form a hollow section 70' along the whole periphery of the reinforcing frame 70, it is possible to injection mold the reinforcing frame 70 easily, without using high pressure gas, or a resin receiver as shown in FIG. 7.

In addition, because the four corners of the reinforcing frame are a hollow construction with high rigidity, even if the middle section of the lower horizontal beam 72*c* is a solid construction, it compares favorably for strength.

Moreover, because the wide upper horizontal beam 71 becomes a articles bearing surface, as well as being easy to attach the non-slip tape 81 and 82, the strength of the hollow construction can be effectively used.

In the second embodiment, the upper horizontal beam 71 and the vertical beams 73 and 74 have hollow structures. Instead, the lower horizontal beam 72*c* and the vertical beams 73 and 74 may have hollow structures, and the width of the upper horizontal beam 71 may be made smaller. Moreover, by providing a gas inlet in either of the vertical beams 73 and 74, then the upper horizontal beam 71, either one of the vertical beams 73 and 74, and the lower horizontal beam 72*c* may have hollow structures.

In addition, in the second embodiment, the hollow section 70' reaches to both ends of the lower horizontal beam 72*c*. However, it is acceptable if the hollow section 70' reaches as far as the middle of the vertical beams 73 and 74. In this case, preferably the solid structured section that is not formed hollow has a smaller width, as mentioned above.

Third Embodiment

Figure 15:
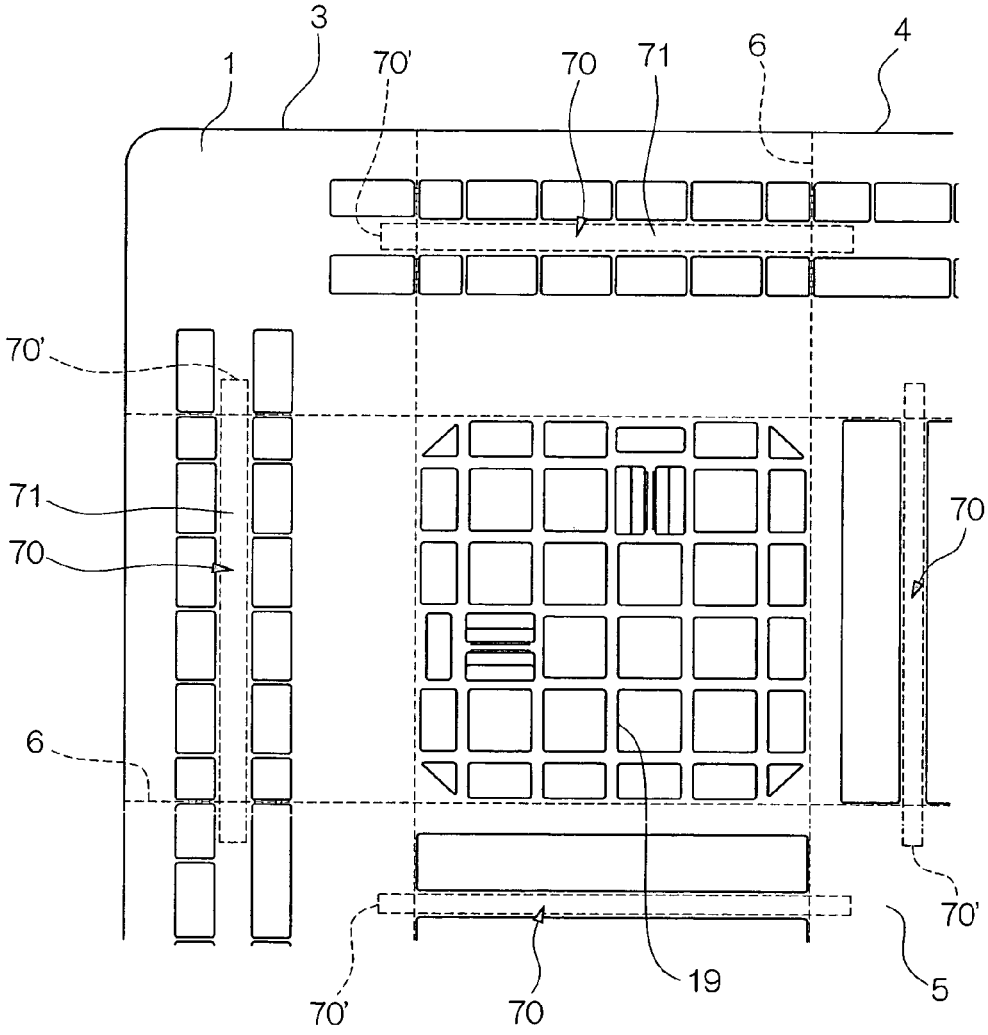
FIG. 15 is a plan view showing a plastic pallet of a third embodiment of the present invention.

Next, FIG. 15 shows a third embodiment of the present invention. The same reference symbols are used for places corresponding to respective parts of the first embodiment, and description is omitted.

In the first embodiment and the second embodiment, the reinforcing frame 70 is formed only between the columns 3 at the four corners and the columns 4 at the side midsection. However, the third embodiment is characterized in that reinforcing frames 70 are also respectively formed between the columns 4 at the side midsection and the column 5 at the center of the pallet. The construction of these added reinforcing frames 70 has the same construction as either of the reinforcing frame 70 of the first embodiment or the reinforcing frame 70 of the second embodiment. Some of the reinforcing frames 70 may have the same construction as the first embodiment, and the other of the reinforcing frames 70 may have the same construction as the second embodiment.

Figure 16:
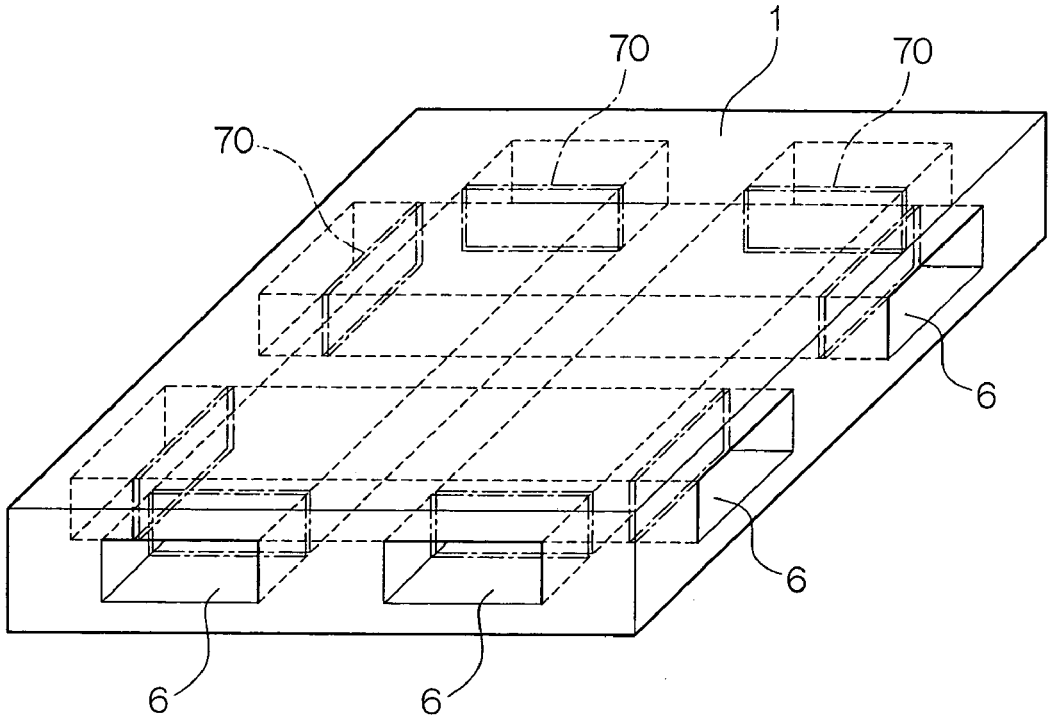
FIG. 16 is an perspective view showing an arrangement of a reinforcing frame in the second embodiment of the present invention.
Figure 17:
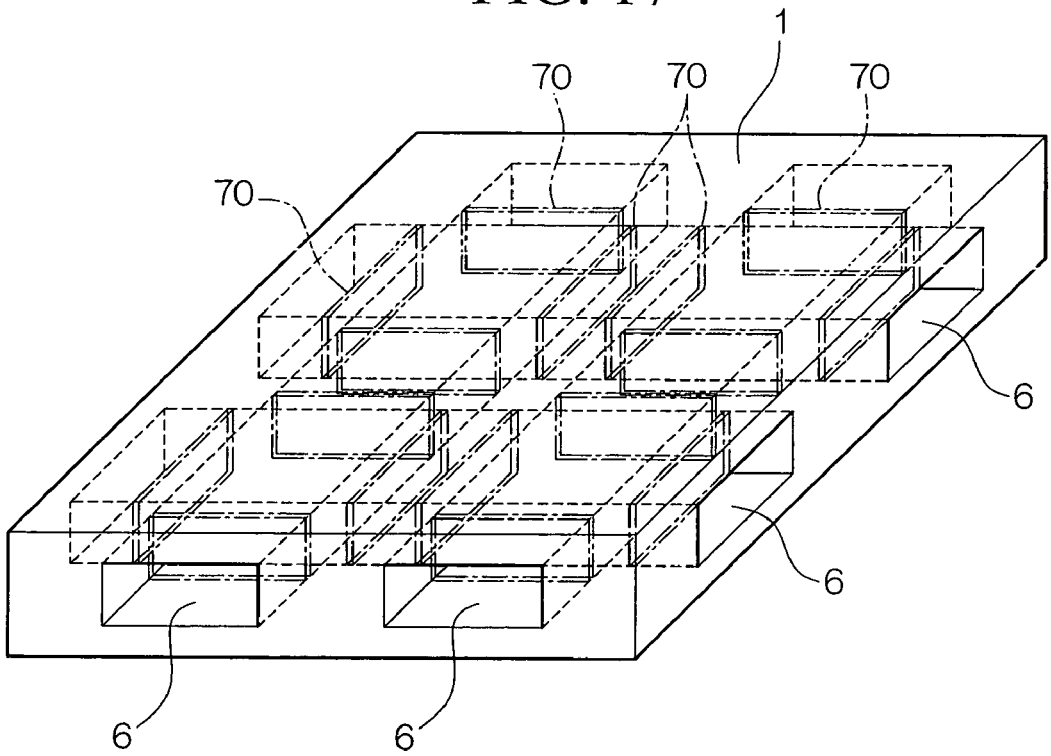
FIG. 17 is an perspective view showing an arrangement of the reinforcing fame in the third embodiment of the present invention.

In the first embodiment and the second embodiment, the reinforcing frames 70 are arranged as shown in FIG. 16. In contrast to this, in third embodiment, as shown in FIG. 17 the number of reinforcing frames 70 is doubled. Therefore, it is possible to prevent deformation of the section surrounding the fork insertion apertures 6 and to increase the strength of the plastic pallet.

Figure 18:
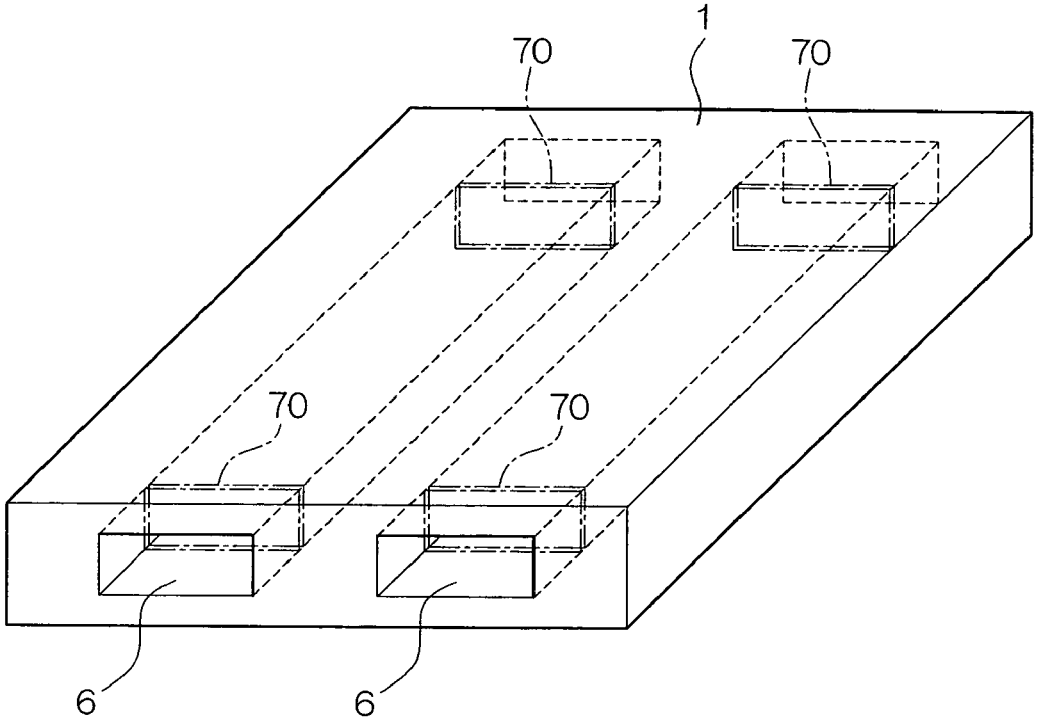
FIG. 18 and FIG. 19 are perspective views showing modified examples of the present invention.
Figure 19:
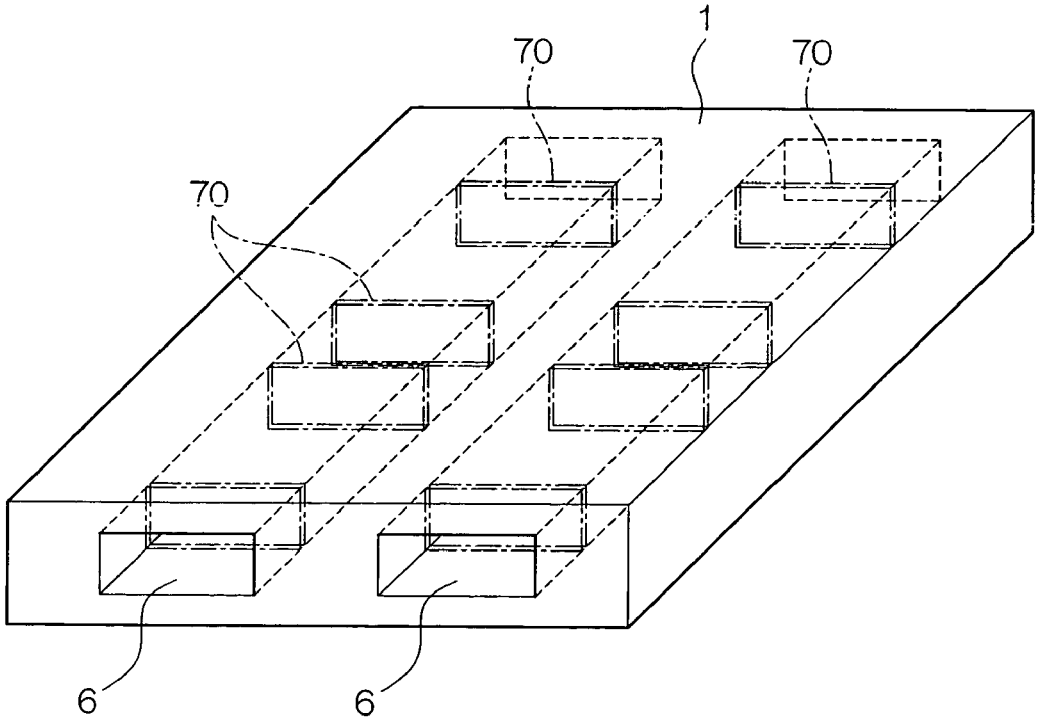

FIG. 16 and FIG. 17 are four-was type pallets. In the case of a two-way type pallet, the reinforcing frames 70 may be arranged as shown in FIG. 18 and FIG. 19.

Fourth Embodiment

Figure 20:
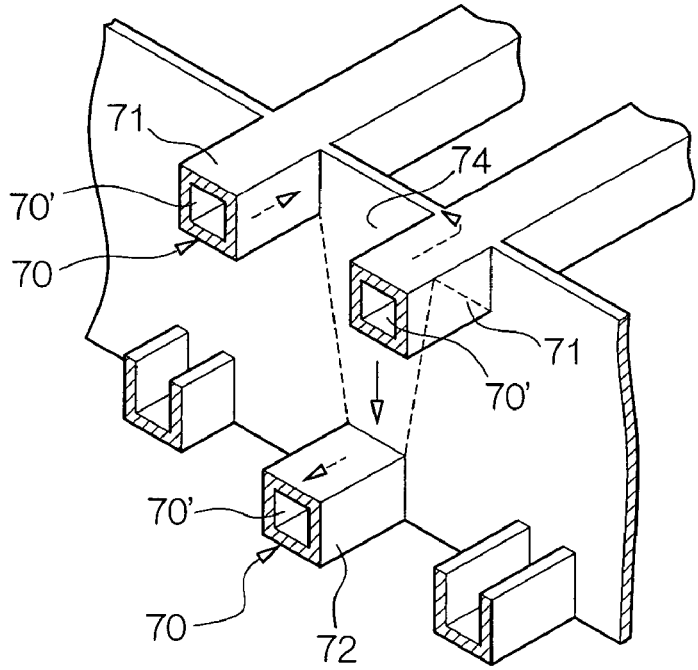
FIG. 20 through FIG. 22 are perspective views showing other embodiments of the reinforcing frame.

FIG. 20 is a partially cut away perspective view showing the reinforcing frame 70 of the fourth embodiment. In the first embodiment and second embodiment, the reinforcing frame 70 comprises the upper horizontal beam 71, the vertical beams 73 and 74, and the lower horizontal beam 72 (or 72*c*) arranged on the same plane. However, this type of construction creates the necessity of using a slide core when injection molding.

Therefore, in this fourth embodiment, by arranging the upper horizontal beam 71 and the lower horizontal beam 72*c* alternately with each other when viewed in the vertical direction, it is possible to form the reinforcing frame 70 without using the slide core. As a result, molding efficiency can be further increased.

That is, the gas that is blown in from the center section of the upper horizontal beam 71, passes though the vertical beams 73 and 74 that form one section of the vertical wall, and flows to the lower horizontal beam 72 (or 72*c*) arranged alternately with the upper horizontal beam 71 when viewed in the vertical direction, so that at least both end sections of the lower horizontal beam 72 (or 72*c*) are formed hollow.

Figure 21:
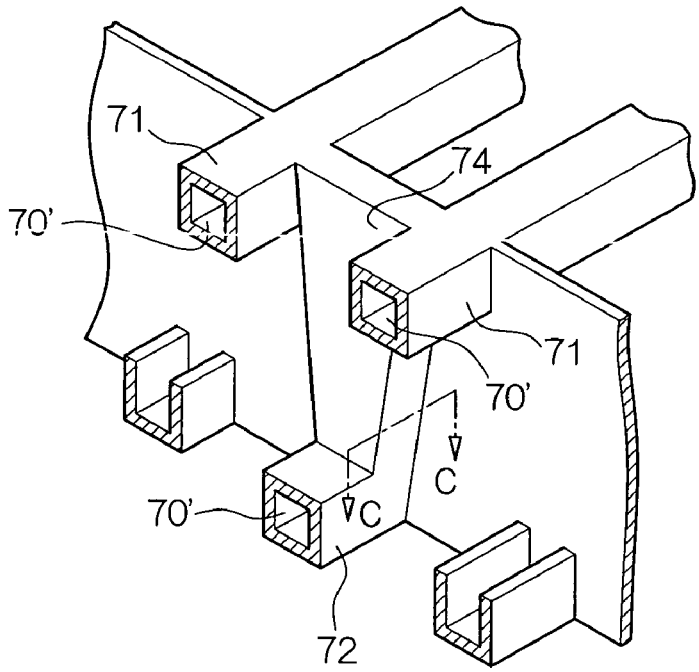
Figure 22:
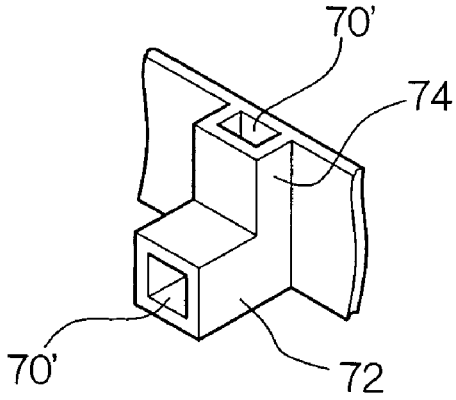
Figure 23:
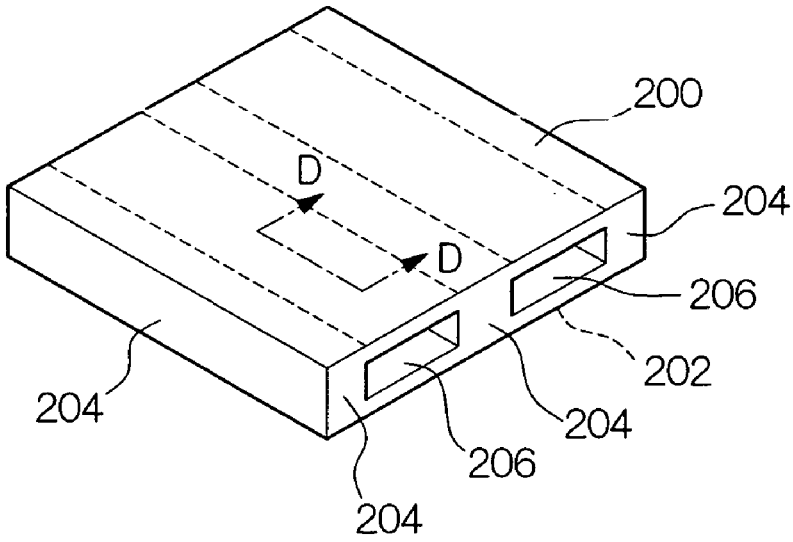
FIG. 23 is an perspective view showing the outward appearance of the plastic pallet.
Figure 24:
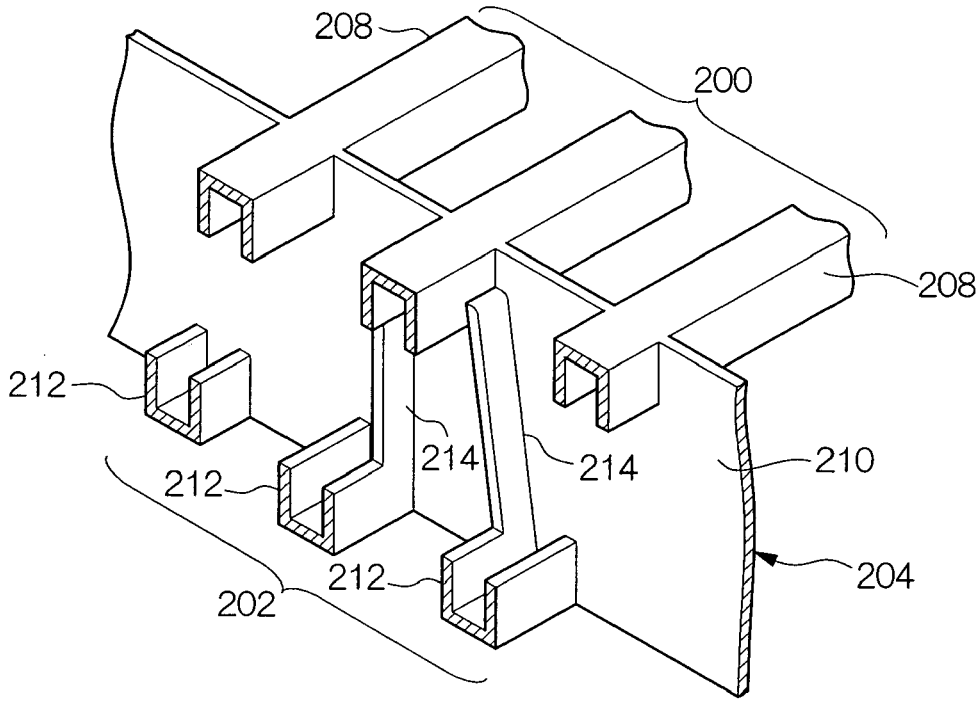
FIG. 24 is a perspective view showing the main parts of a conventional plastic pallet (a cross-section along the line D—D in FIG. 23).
Figure 25:
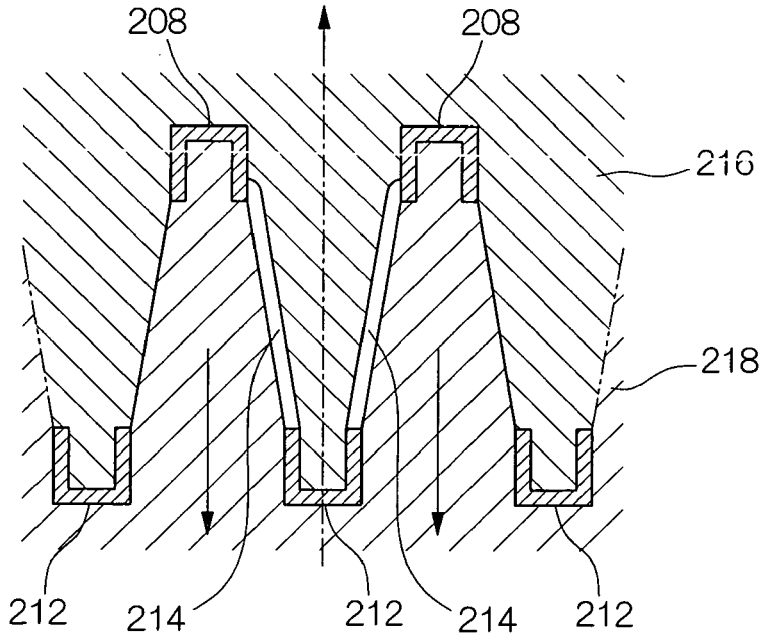
FIG. 25 is a cross-section illustrating a construction method of the conventional plastic pallet.

In the embodiment of FIG. 20, the thickness of the vertical beams 73 and 74 is the same as the vertical wall. However, as shown in FIG. 21 and FIG. 22 (a perspective view on line C—C in FIG. 21), it is possible to make these slightly thicker than the vertical wall. If the thickness is made greater in this way, the hollow section 70' inside the reinforcing frame 70 is easier to form, and the strength of the vertical beams 73 and 74 is also increased.

The constructions such as in FIG. 20 through FIG. 22 are beneficial, particularly in the third embodiment, when forming the reinforcing frame 70 between the columns 4 at the side midsection and the column 5 at the center of the pallet. This is because it becomes difficult to use a slide core the farther the position from the opening end of the fork insertion aperture 6.

EXPERIMENTAL EXAMPLES

Experiment 1

Beams (bars) having sections shown in FIG. 26 through FIG. 31 were formed from polypropylene, the geometrical moments of inertia were measured, and the bending strengths were compared. The results are shown in Table 1.

TABLE 1

Figure 26:
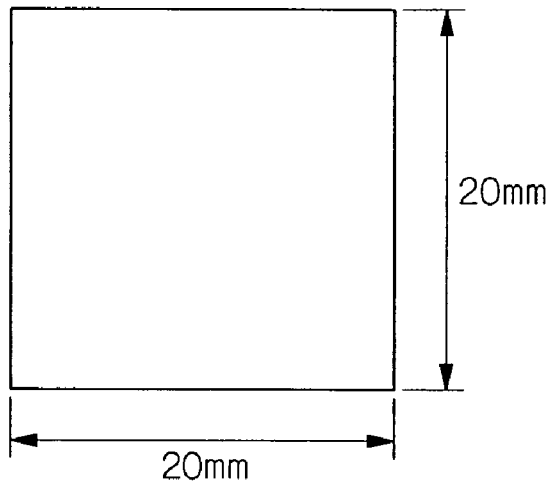
FIG. 26 through FIG. 31 are cross-sections of test pieces used for strength tests.
Figure 27:
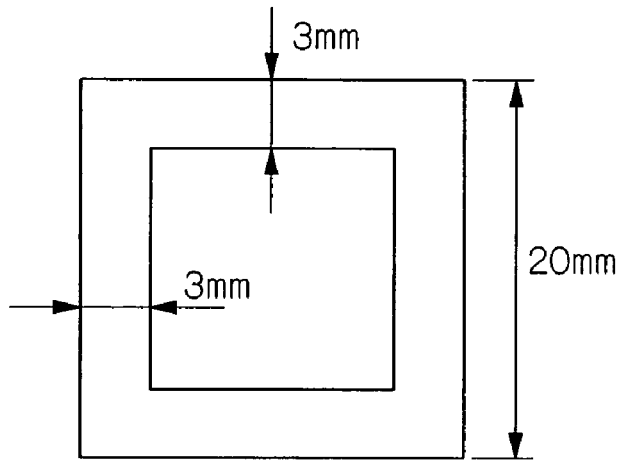
Figure 28:
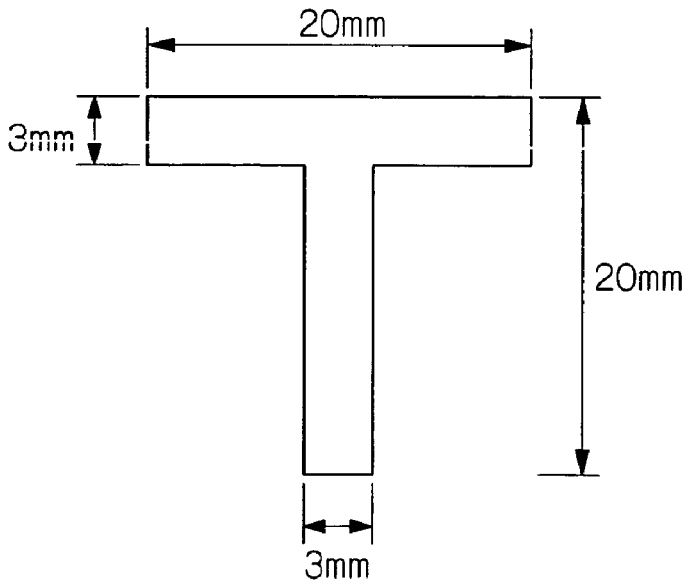
Figure 29:
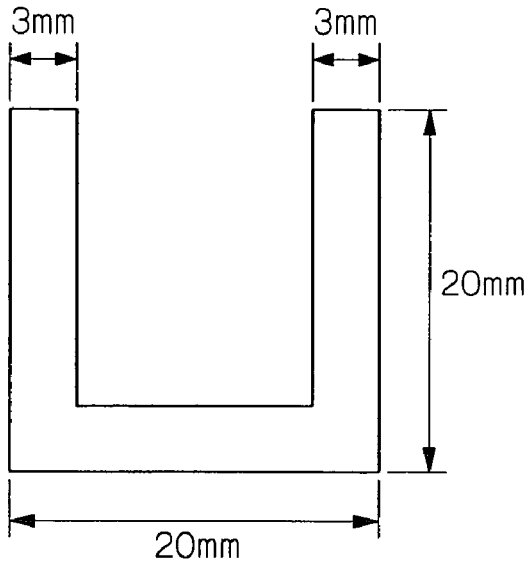
Figure 30:
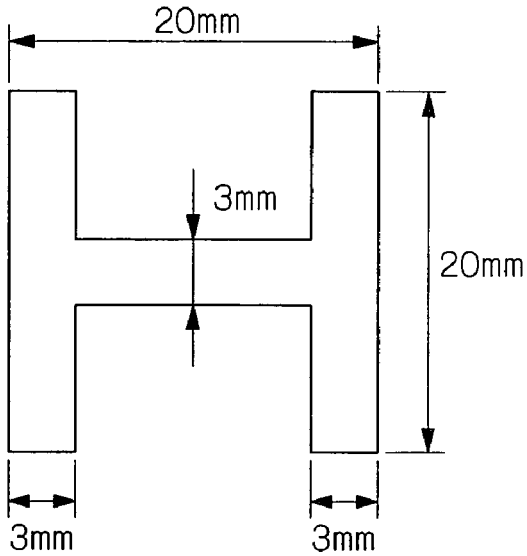
Figure 31:
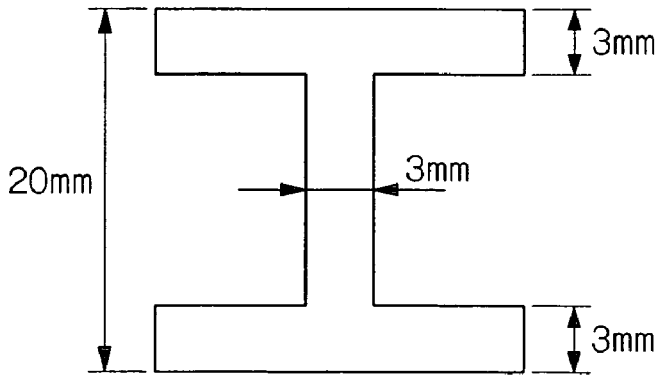

| TEST PIECE | FIG. 26 | FIG. 27 | FIG. 28 | FIG. 29 | FIG. 30 | FIG. 31 |
|---|---|---|---|---|---|---|
| RELATIVE STRENGTH | 105 | 100 | 40 | 62 | 40 | 93 |

From the results of Table 1, it can be seen that in the case of the hollow construction shown in FIG. 27, the strength is hardly decreased compared to the case of FIG. 26 which is not hollow, while compared to the conventional constructions shown in FIG. 28 and FIG. 29, the strength can be significantly improved.

Experiment 2

A plastic pallet having a reinforcing frame 70 was actually molded, and two test pieces 1 having a length of 200 mm were cut from the hollow upper horizontal beam 71.

On the other hand, two U shaped beams were cut from a conventional plastic pallet having beams of U-shaped cross-section and having the same dimensions as the former plastic pallet, to obtain test pieces 2.

The dimensions of the test piece 1 were, length 200 mm, transverse width 36.0 mm, vertical width 35.0 mm, and wall thickness 4.0 mm. The dimensions of test piece 2 were also: length 200 mm, transverse width 36.0 mm, vertical width 35.0 mm and wall thickness 4.0 mm.

Opposite ends of the two test pieces 1 and 2 were supported, and the amount of bending (mm) for the case with a 200 kgf applied to the middle, and the load (kgf) necessary to displace the middle section by 5 mm, were measured. The results are shown in Table 2. The upper number is the result for the first test piece, and the lower number is the result for the second test piece.

TABLE 2

| | Bending amount (mm) | Load to displace by 5 mm (kgf) |
|---|---|---|
| Test piece 1 (from the | 3.5 | 269 |
| present invention) | 3.8 | 255 |
| Test piece 2 (from the | 5.2 | 193 |
| conventional model) | 5.7 | 180 |

As shown in Table 2, with test piece 1 the bending strength was improved by 35 to 40% compared to test piece 2. Consequently, a significant improvement in strength for the whole pallet can be expected.

INDUSTRIAL APPLICABILITY

The present invention, in a plastic pallet used for the transportation and storage of articles, enables an increase in the rigidity of the surroundings of the fork insertion aperture in particular, by forming a hollow structure reinforcing frame in at least one part so as to surround the fork insertion aperture, and enables an increase in the strength of the whole pallet. Moreover, by making at least one part of the reinforcing frame a hollow structure, the weight of the pallet increases only slightly compared to the strength improvement, and production efficiency is also increased.

What is claimed is:

1. A plastic pallet having an upper plate part and a lower plate part arranged parallel to each other, and a plurality of columns connecting the upper plate part and lower plate part, and fork insertion apertures being formed between the columns, wherein corresponding to at least one of the fork insertion apertures there is formed at least one reinforcing frame surrounding a cross-section perpendicular to a fork insertion direction of the fork insertion apertures, and a hollow portion is formed in an interior of at least one portion of the reinforcing frame, and wherein the reinforcing frame has an upper horizontal beam formed along the upper plate part, a lower horizontal beam formed along the lower plate part, and a pair of vertical beams connecting the upper horizontal beam and the lower horizontal beam, and at least three of the upper horizontal beam, the lower horizontal beam and the pair of vertical beams have a hollow portion for communicating with each other.

2. A plastic pallet according to claim 1, wherein of the upper horizontal beam, the lower horizontal beam and the pair of vertical beams, a section which does not have a hollow portion in the interior has a width smaller than that of a section which does have a hollow portion in the interior.

3. A plastic pallet according to claim 1, wherein the upper horizontal beam, the lower horizontal beam and the pair of vertical beams all have hollow portions for communicating with each other.

4. A plastic pallet having an upper plate part and a lower plate part arranged parallel to each other, and a plurality of columns connecting the upper plate part and lower plate part, and fork insertion apertures being formed between the columns, wherein corresponding to at least one of the fork insertion apertures there is formed at least one reinforcing frame surrounding a cross-section perpendicular to a fork insertion direction of the fork insertion apertures, and a hollow portion is formed in an interior of at least one portion of the reinforcing frame, and wherein a gas inlet for communicating the hollow portion with the outside of the plastic pallet is formed in an outer face of the reinforcing frame, and a non-slip member to close the gas inlet is attached to the upper plate part or the lower plate part.

* * * * *